US005949989A

United States Patent [19]

Falkowski et al.

[11] Patent Number: 5,949,989

[45] Date of Patent: Sep. 7, 1999

[54] METHOD OF DESIGNING AND DEVELOPING ENGINE INDUCTION SYSTEMS WHICH MINIMIZE ENGINE SOURCE NOISE

[75] Inventors: Alan Falkowski, Lake Orion; Piotr Czapski, Farmington Hills, both of Mich.

[73] Assignee: Chrysler Corporation, Auburn Hills, Mich.

[21] Appl. No.: 08/883,773

[22] Filed: Jun. 27, 1997

[51] Int. Cl.[6] ..... G06G 7/48

[52] U.S. Cl. ..... 395/500.29; 395/500.28; 395/500.27

[58] Field of Search ..... 364/578

[56] References Cited

U.S. PATENT DOCUMENTS

| | | | |
|---|---|---|---|
| 3,990,414 | 11/1976 | Malpherres . | |
| 4,538,556 | 9/1985 | Takeda . | |
| 5,107,800 | 4/1992 | Araki et al. . | |
| 5,119,427 | 6/1992 | Hersh et al. | 381/71.14 |
| 5,333,576 | 8/1994 | Verkleeren . | |
| 5,386,689 | 2/1995 | Bozich et al. | 60/39.33 |
| 5,581,619 | 12/1996 | Shibata et al. | 381/71.4 |
| 5,650,599 | 7/1997 | Madden et al. | 181/218 |
| 5,748,749 | 5/1998 | Miller et al. | 381/71.5 |
| 5,850,458 | 12/1998 | Tomisawa et al. | 381/71.3 |

*Primary Examiner*—Kevin J. Teska
*Assistant Examiner*—Hugh Jones
*Attorney, Agent, or Firm*—Kenneth H. Maclean

[57] ABSTRACT

A method of minimizing engine noise emitted from a motor vehicle air intake system. An objective function to be minimized, such as emitted engine noise, is selected. A model of a motor vehicle engine and intake manifold as an acoustic source is generated. Next, a model of required air induction system components is generated. A set of air induction system components and system dimensional constraints is selected. A model of the air induction system is then created given the generated models of the acoustic source and the required induction system components, the selected air induction system components and the system dimensional constraints to thereby minimize the objective function. The methodology of the present invention minimizes the guesswork associated with multi-component induction system design, as it ties all functions together into a model that can be easily manipulated as needed in response to changing design parameters.

18 Claims, 4 Drawing Sheets

METHOD OF DESIGNING AND DEVELOPING ENGINE INDUCTION SYSTEMS WHICH MINIMIZE ENGINE SOURCE NOISE

BACKGROUND OF THE INVENTION

1. Technical Field

The present invention relates generally to motor vehicle induction systems, and more particularly to a method of designing a motor vehicle induction system that minimizes the amount of engine noise emitted by that system.

2. Discussion

It is desirable to design an engine induction system such that engine noise emitted by the system is minimized. Conventionally, emitted system noise is minimized through implementation of an objective, or cost, function defined by several objective parameters. Typically, total sound pressure level (SPL), often referred to as dB(A) noise level, is engine noise emitted by the engine through the induction system weighted by human ear perception characteristics, and is the most commonly used objective parameter. Unweighted SPL can alternatively be utilized in place of weighted SPL. Another objective parameter that may be utilized is total loudness as defined by International Standards Organization (ISO) R 532b recommendation. Further, induction system dimensions may also be utilized in the objective function, as well as system component volumes and/or lengths.

The function as defined by the above parameters can thus be used to minimize noise levels associated with the system. The function may also be used to minimize system dimensional requirements, and thus production costs and space requirements for an induction system.

Conventionally, the above function has been implemented through trial and error adjustment of the above mentioned parameters. Therefore, overall system optimization is difficult to achieve, as adjustment of each of the numerous parameters in the function affects the weighting factor associated with the other function parameters.

Also, software engine and induction system modeling programs exist that allow an engine and induction system to be modeled as a noise source. Software programs also exist that allow induction system part sizes and locations to be modeled. However, no methods exist that allow objective parameters such as those mentioned above to be weighted according to specified design criteria to allow different systems to be designed for different engines. Also, numerous trial and error iterations must be run to generate a system model. Each iteration could lead to degradation in system design rather than an improvement, due to the inherent subjectiveness involved in changing system parameters in the existing programs.

SUMMARY OF THE INVENTION

Accordingly, the present invention provides a method of designing an engine induction system to minimize engine source noise through use of an objective function defined by a plurality of weighted variables. The method of the present invention minimizes sound pressure level (db or db(A)) at one or more of any number of locations within the motor vehicle, depending upon particular design requirements. The methodology can be realized to either minimize the objective function over all engine speeds or to minimize the difference between a specified target value and the generated value of the system model by specifying the objective function parameter values at all engine speeds before the start of the optimization process.

In particular, the method of the present invention minimizes engine noise emitted from a motor vehicle air intake system. The method includes the steps of selecting an objective function to be minimized; generating an acoustic source model of a motor vehicle engine and intake manifold; generating a model of required air induction system components; selecting a set of air induction system components and system dimensional constraints; and generating a model of the air induction system given the generated models of the acoustic source and the required induction system components, and the system dimensional constraints to thereby minimize the objective function.

In addition, the present invention provides a motor vehicle air intake design system that includes a controller, and a memory operatively associated with the controller that stores an objective system parameter to be minimized and that is programmed with system optimization logic. A first acoustic source submodel of a motor vehicle engine system, a second submodel of air intake system components that are operatively coupled to the acoustic source, and a third submodel of an air intake system environment generated from intake environment dimensional constraints are also provided. The controller is operative to generate an optimized model of an air intake system through the optimization logic given the objective system parameter, and the first, second and third submodels as inputs to the logic.

DETAILED DESCRIPTION OF THE PREFERRED EMBODIMENT

Figure 1:
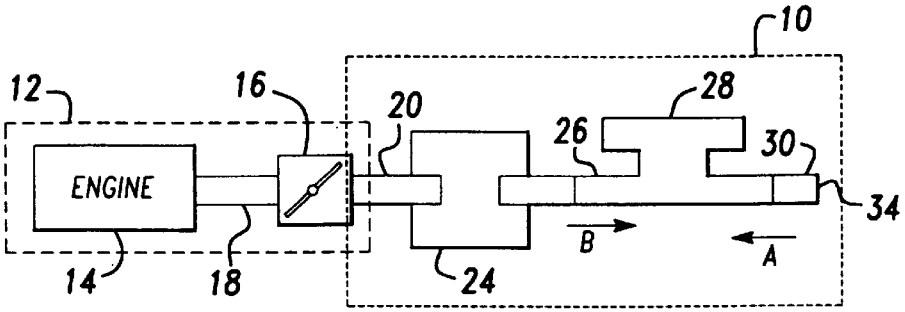
FIG. 1 is a schematic block diagram of an induction system modeled by the optimization logic of the present invention.
Figure 2A:
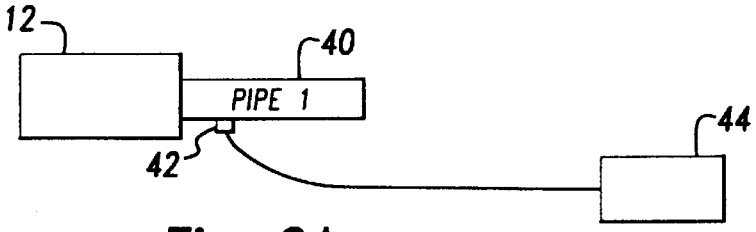
FIGS. 2A–2D are schematic block diagrams illustrating the generation of data relating to motor vehicle engine impedance for use by the implementation logic of the present invention.
Figure 2B:
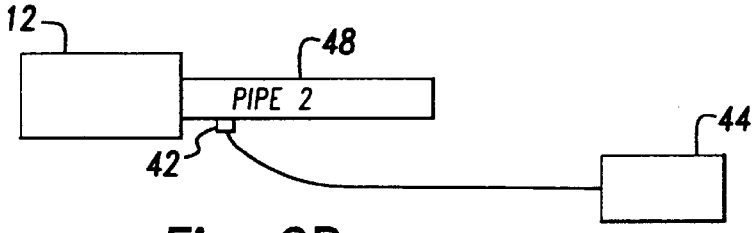
Figure 2C:
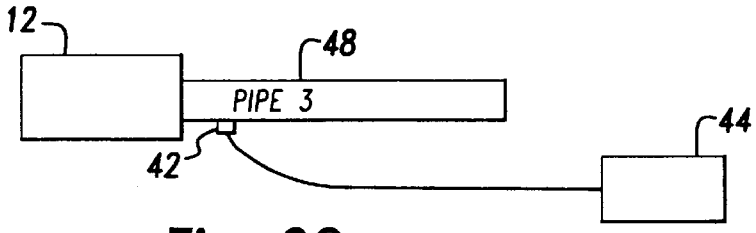
Figure 2D:
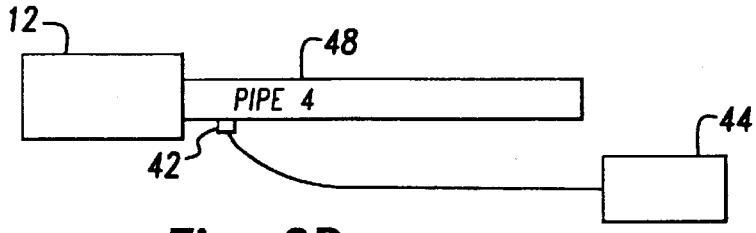

Referring to the drawings, FIG. 1 illustrates an air induction system 10 that is designed according to the system design methodology of the present invention. The air induction system 10 is operatively coupled to a noise source 12, which consists of a conventional motor vehicle engine 14 having an associated engine throttle 16 and a fresh air intake manifold 18, all of which are of the type well known in the art. A hose 20 is connected to the throttle body and couples the acoustic source 12 to the air induction system 10.

The air induction system 10 includes a first component 24, which is preferably an air filter to filter dirt and other particles from the air before the air enters the manifold 18. Alternatively, the component may be a resonator for reducing noise associated with resonant frequencies produced by the engine system 12. The component 24 is next coupled via hose 26 to a resonator 28, which is preferably a Helmholtz resonator used to minimize the noise being emitted by the acoustic source. The Helmholtz resonator 28 in turn is coupled by a hose 30 to an air inlet 34 through which fresh air enters the air induction system and is input into the engine system 12. Therefore, while fresh air flows from right to left through the air induction system 10 as indicated by Arrow A, engine noise is emitted from the engine system 12 in the direction as indicated by arrow B.

FIG. 2 illustrates one process of generating a first submodel of the engine 14 and intake manifold 18 as an acoustic source, as characterization of the engine source impedance is required by the methodology of the present invention. The induction system is connected to the engine system 12 preferably at the throttle body 18. Initially, a straight pipe 40 of a first predetermined length is connected directly to the throttle body 16. The engine is then run at a first RPM setting, and SPL and particle velocity associated with the sound wave being emitted from the acoustic source (hereinafter referred to as velocity) is measured by a sensor 42, which is preferably an instrument grade pressure transducer, in the crank angle domain. Pressure and velocity data are transmitted from the sensor 42 to a data recorder, or controller, 44 that includes an Intel Pentium processor and an associated memory.

The collected data is then converted to the frequency domain through a Fast Fourier Transform (FFT) method. Engine frequencies of interest are at or below 1500 hertz, as the associated frequencies correspond to the bandwidth of interest for intake noise. The DC component of these signals is removed, as, for test purposes, only fluctuations about the mean flow conditions are of interest. The data is preferably stored in the controller memory for subsequent retrieval and use by the methodology of the present invention.

After the inducted air pressure and velocity are measured in conjunction with the first pipe 40, first pipe 40 is removed, and a second pipe 48 having a second predetermined length is attached to the throttle body. Pressure and velocity measurements are taken in conjunction with the second pipe 48 and are stored in the controller 44. Similar measurements are then taken for pipes 50, 52 having third and fourth predetermined lengths. The resulting generated data is stored in the controller 44 for subsequent use by the methodology of the present invention as will now be described.

It should be appreciated at this point that an alternative method of calculating induction system air pressure and velocity may be realized through the use of commercially available software packages such as Ricardo's Wave Engine Simulation, which simulate thermodynamic processes associated with internal combustion engines. Simulated induction system air pressure and velocity may be determined through such process simulation, and the simulated data can then be used in place of, or in accompaniment with, measured data.

Typically, acoustical impedance is generated from induction system air pressure and velocity. Similarly, the mach number of the inductive air flow, which is derived from the mean value of the inducted air flow velocity divided by the speed of sound, is also calculated. These generated values are then stored in the controller and used as inputs to the induction system modeling methodology of the present invention.

Figure 3:
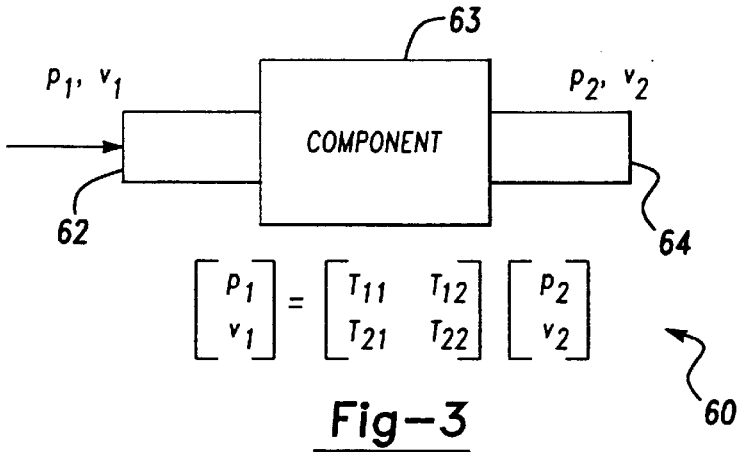
FIG. 3 illustrates a system component used in the system model of the present invention and the associated transmission matrix.

Referring now to FIG. 3, a transmission matrix shown at 60 is used in a second submodel of the present invention to model intake system components. The transmission matrix submodel relates induction system inlet air pressure and velocity $P_1$, $V_1$ at an inlet 62 of an induction system component 63, to the pressure and velocity $P_2$, $V_2$ at a component outlet 64. Transmission matrix coefficients $T_{11}$, $T_{12}$, $T_{21}$, $T_{22}$ are determined by the geometrical dimensions of the component. The induction system component submodel assumes no temperature gradients in the system and does not take non-linear effects into consideration. Preferably, the transmission matrix coefficients for most commonly used induction system components are programmed into the submodel, as most of these coefficients have been derived analytically from published sources. However, if a perforated concentric tube resonator component, such as that disclosed in related pending U.S. patent application Ser. No. 08/883,774, now U.S. Pat. No. 5,839,405 entitled Single/Multi-Chamber Perforated Tube Resonator for Engine Induction System is utilized, no closed end analytical solution exists, and the transmission matrix for such an element must be calculated numerically.

Figure 4:
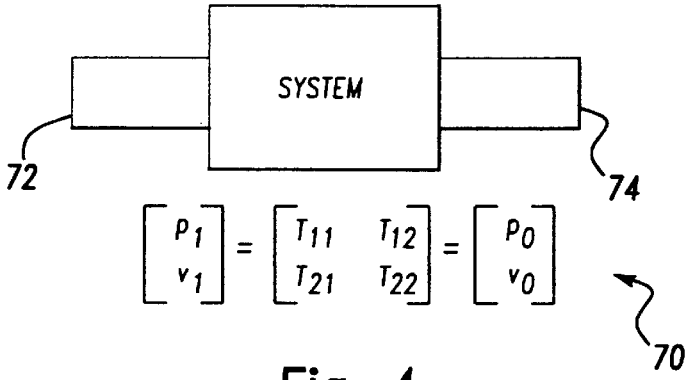
FIG. 4 illustrates a diagram of an induction system modeled by the optimization logic of the present invention and the associated transmission matrix.

FIG. 4 illustrates at 70 an overall transmission matrix for the induction system extending from the throttle body 16 to the air inlet 34. The matrix is generated by multiplying the transmission matrices of all components to be utilized in the system to produce transmission coefficients $T_{11}$, $T_{12}$, $T_{21}$, $T_{22}$ . The overall transmission matrix relates pressure and velocity, $P_l$, $V_l$, shown at 72, at the throttle body to pressure and velocity $P_o$, $V_o$, shown at 74, at the fresh air inlet. The matrix 70 is then utilized to determine overall component dimensions and locations, as will be described below.

Figure 5:
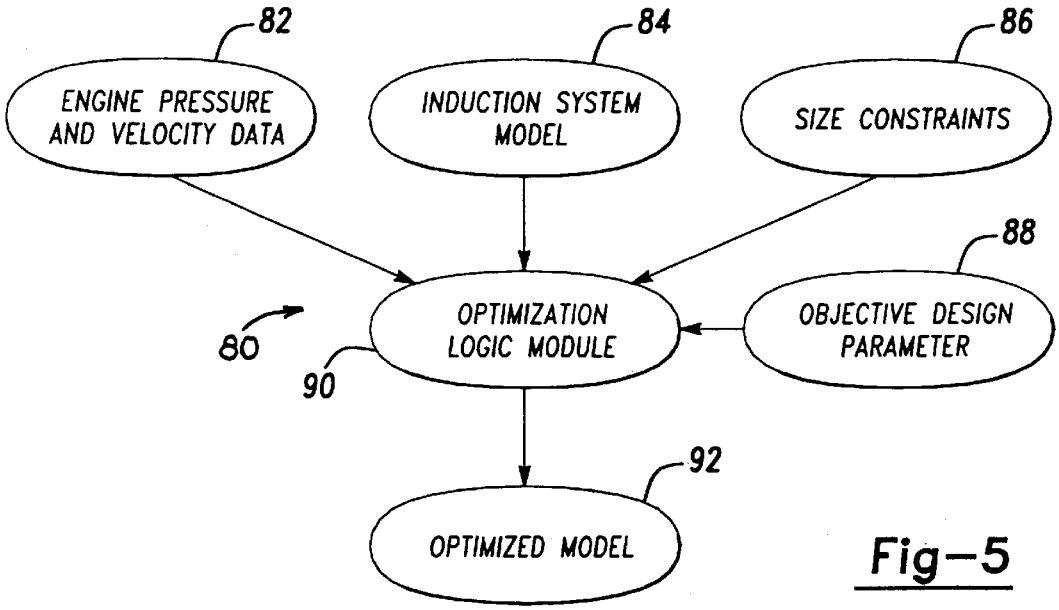
FIG. 5 is an entity relationship diagram illustrating the process of utilizing submodels created from input design parameters of the present invention to optimize induction system design.

Referring to FIG. 5, an entity relationship diagram illustrating the three submodels utilized by the induction system optimization logic of the present invention is shown generally at 80. Engine pressure and velocity data from the engine submodel 82, along with parameters from the induction system submodel 84, and implementation area size constraints comprising a third system submodel 86, are the three sets of variables that are input into the optimization logic 90 of the present invention. The optimization logic 90 is preferably a genetic optimization program, such as the type publicly available from the National Space and Aeronautics Administration, implemented in conventional C programming language. The logic mutates and combines the numerous possible configurations given the input parameters from the submodels 82, 84, 86 and the objective parameter 88 until an optimal system model is generated. The logic therefore allows a solution 92 to be achieved by interrelating the numerous parameters from all of the above submodels, given a specified objective parameter. Conventional optimization methods typically utilize input parameters only from individual submodels such as those described above, and do not permit interrelation of parameters such as dimensional constraints, part sizes, and engine noise source characteristics.

It should be appreciated that the objective parameter 88 to be minimized is total sound pressure level (SPL) weighted by human ear characteristics. However, this parameter may also be input as unweighted SPL, or, alternatively, total loudness as defined by ISO R 532b recommendation. Sound quality metrics are other objective parameters that may be introduced such that the noise emitted includes acoustically pleasing resonant harmonics. A single value for any of these objective parameters is obtained by adding respective contribution from a number of engine speeds and frequencies. This objective parameter is input along with other induction model parameters, including data relating to existing induction system component volumes and/or lengths. Each of these parameters may be weighted to emphasize particular engine operating speeds, such as those speeds, or the range of speeds, correlating to engine acceleration characteristics and gear shift points. In addition, SPL may be input with respect to noise levels outside of the vehicle, as well as inside of the vehicle. Those levels inside the vehicle may be calculated from outside noise levels using a vehicle transfer function, as is well known in the art.

In addition, referring to the design size constraints 86, any number of constraints on system size and geometry can be specified. Each dimension of every element in the induction system can be constrained to be within certain limits. Moreover, linear constraint functions can be added to the methodology of the present invention, such as to the matrix 70, to assure that entire components or component combinations fit within the space available. These constraints are a critical part of system optimization since the constraints assure that an optimal design can be realized.

Minimum and maximum values for each input parameter are implemented by limiting the search space of the optimization methodology of the present invention. These linear constraints are then enforced through use of penalty functions programmed into the methodology.

Figure 6:
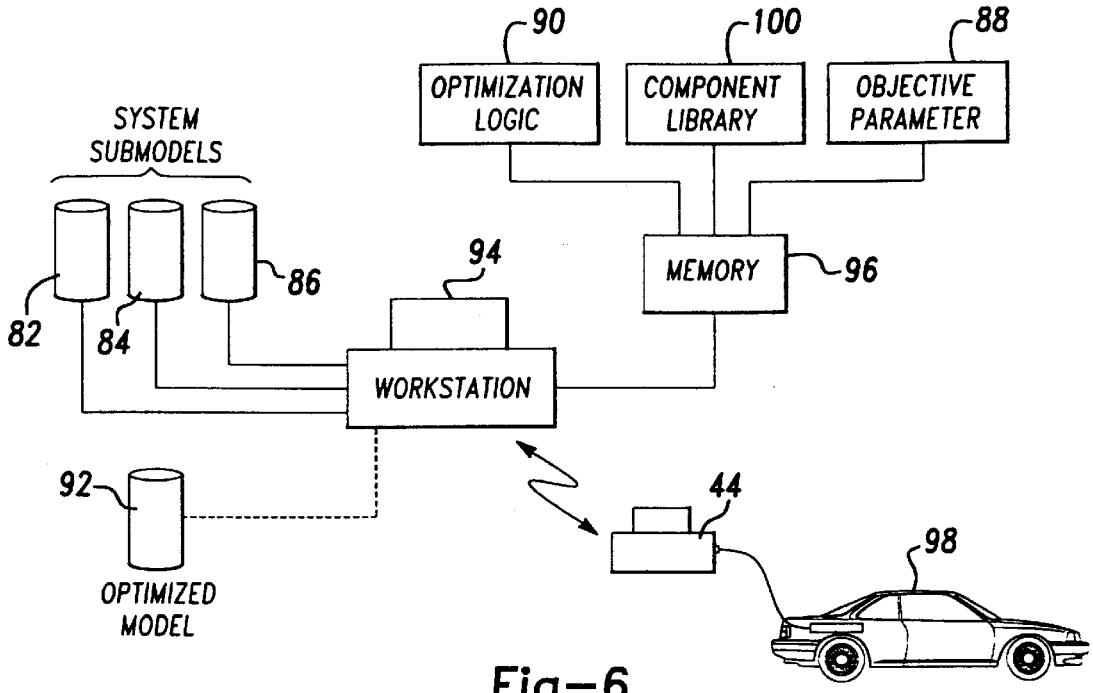
FIG. 6 is a schematic block diagram illustrating the system utilized to implement the optimization logic of the present invention.

FIG. 6 illustrates a system for generating an optimized induction system model. The system includes a computer 94, such as an SGI workstation, that includes a memory 96, such as a random access memory (RAM), read only memory (ROM) or any other type of conventional computer memory. Engine pressure and velocity data is collected from the engine and intake manifold 12 (FIGS. 2A–2D) located in a motor vehicle, such as the motor vehicle 98. The collected data is then downloaded from the computer 94 to the memory 96 for use in generating the first submodel 82. The memory 96 also includes a library of components 100 for selection and use in generating the second submodel 84, as well as the input objective parameter 88 that is to be minimized by the optimization logic software module 90. Dimensional constraints are entered into the third submodel 86 through the workstation in a conventional data entry manner.

Once all data is entered into the submodels 82, 84, 86, and the memory 96, the workstation runs the optimization logic software module 90 of the present invention to generate the optimized induction system model 92. Typical run times for such a workstation are between two and twelve hours, depending upon specific parameters used and the system being modeled.

Optimal induction system dimensions are found through global optimization of the objective parameter through use of the optimization logic of the present invention. The logic has been shown to converge to the same global solution when initialized with several different initial model conditions. In addition to the optimized solution generated by the methodology of the present invention, generated close to optimized solutions can also be saved from a single optimization run for comparison of various designs in a post-processing stage. Non-optimized solutions can in some cases be preferable due to factors not included in the objective function, such as subjective sound quality or ease of manufacturing.

Figure 7:
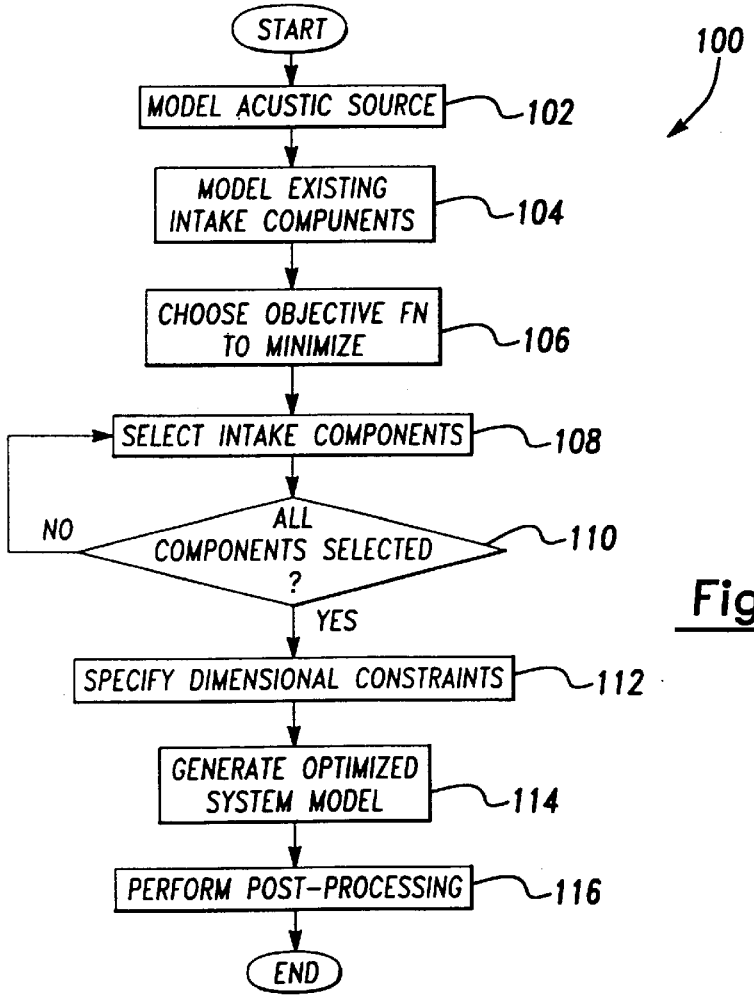
FIG. 7 is a flow diagram illustrating the optimization logic of the present invention.

Referring to FIG. 7, a flow diagram illustrating the steps used to implement the methodology of the present invention is shown generally at 100. At step 102, engine noise and pressure data is input into the first submodel. At step 104, data on existing induction system components, including the air cleaner, inlet pipe and connecting hoses is input into the second submodel. At step 106, the objective function to be optimized is input into the memory 96. At step 108, the intake system elements to be utilized are chosen from the induction system elements library 100 and input into the second submodel. At step 110, the logic determines if all intake components to be used in the system model have been entered. If not, the logic returns to step 108, and further components are selected. If all components have been selected, at step 112, system dimensional constraints and the size of the intake system elements chosen at step 108 are input into the third submodel. At step 114, the optimization logic software block optimizes the intake system design to minimize the objective function input at step 106, given the elements chosen at step 108 and the constraints input at step 112. Subsequently, at step 116, the methodology processes the data output at step 114 for evaluation purposes.

It should be appreciated that at step 116, a number of post-processing options are available. Graphs of total SPL versus RPM in db and db(A) may be generated and used for comparison of different designs and the baseline system. Also, frequency plots of sound levels at each RPM may be created. Loudness plots versus RPM can also be generated. Total volume and length of the induction system may also be calculated. To compare psychoacoustic noise characteristics, digital sound files may also be created and saved. In addition, subjective evaluation of the engine induction noise is then possible through listening to the outputs of different generated designs.

In the preferred embodiment of the present invention, software has been used to design engine induction systems for Chrysler 2.4 liter, 3.5 liter and 2.0 liter engines. Prototypes of the resulting optimized design systems were built, and noise levels recorded in a dynamometer test room. Improvements of as much as 10 db(A) over baseline production system were achieved. Significant frequency content refinements of the noise spectra were also obtained. Subjective evaluation of the recorded data also showed significant improvements in the model designs.

It is contemplated that the methodology of the present invention may be used to design optimized engine induction systems that fit in existing production engine compartment enclosures, thereby minimizing changes necessary to introduce the new, improved systems. For example, for the Chrysler 2.4 liter engine, total induction system volume was decreased from an old production system volume of 10 liters to 6 liters. The number of parts was also decreased through elimination of one resonator.

Figure 8A:
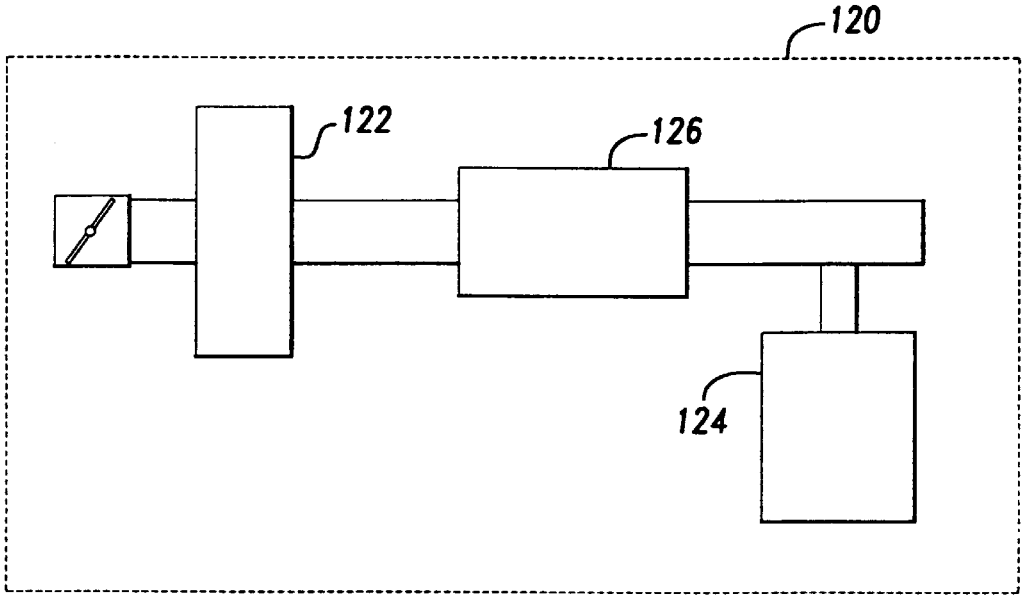
FIGS. 8A and 8B illustrate parameters input into the system of FIG. 6, and the resulting optimized induction system, respectively.
Figure 8B:
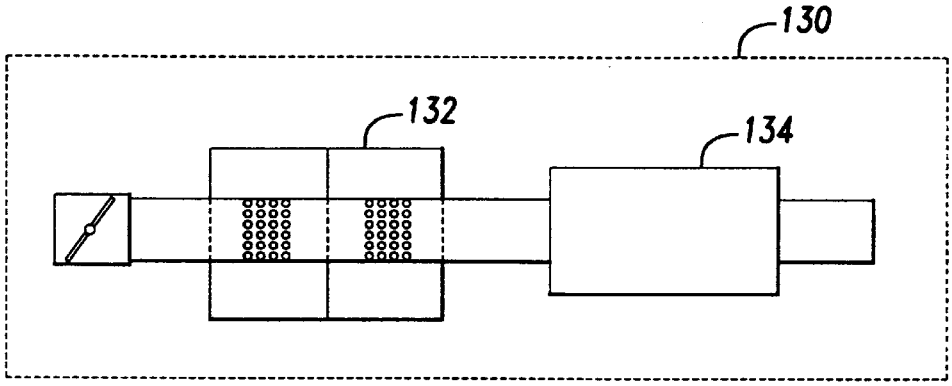

FIG. 8A illustrates an exemplary induction system prior to optimization of the present invention generally at 120. The system includes two resonators 122, 124 and an air cleaner 126. The parameters are associated with a 2.4 liter Chrysler engine. Subsequent to the parameters being processed, the system optimization logic results in an optimized induction system as shown at 130 in FIG. 8B. The system requires only one multi-chamber resonator 132, such as the resonator described in related U.S. patent application Ser. No. 08/883,774, now U.S. Pat. No. 5,839,404 entitled Single/Multi-Chamber Perforated Tube Resonator for Engine Induction System and an air filter 134.

Figure 9:
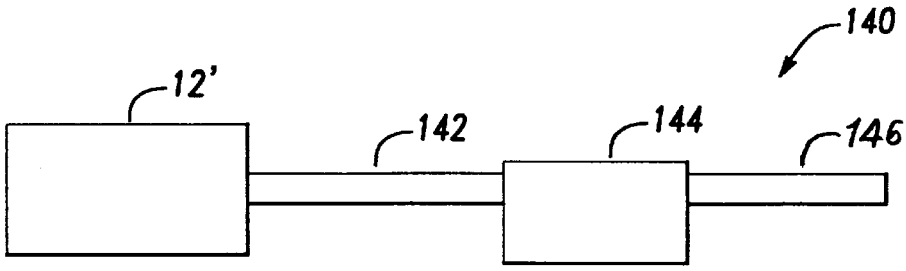
FIG. 9 is a schematic block diagram of an exhaust system modeled by the optimization logic of the present invention.

FIG. 9 illustrates an exhaust system 140 modeled using the optimization logic of the present invention. The exhaust system includes an acoustic noise source 12', an exhaust pipe 142 connected to the acoustic noise source, a muffler 144 connected to the exhaust pipe and an exhaust pipe 146 exiting to the atmosphere. Each of the aforementioned components is of a make and model as selected by the system designer. System parameters, including engine pressure and inducted air velocity data and implementation area size constraints, are entered along with chosen component parameters, corresponding generally to the optimization logic shown and described above for the induction system 10. The logic of the present invention utilizes this data and generates an exhaust system model that minimizes a selected objective parameter, such as emitted engine source noise, given the input parameters.

Upon reading the foregoing description, it should be appreciated that the modeling method of the present invention is designed so that no extensive training is required for engineers or designers to use. The method of the present invention also allows a variety of different modeled induction system designs to be evaluated during the design process. Both of these features represent a significant improvement over conventional complex software modeling systems based on inherently subjective input parameters.

In addition, the method of the present invention is flexible enough to allow different optimization objective functions to be used, therefore allowing examination of variations in system designs. The method of the present invention also decreases system design time in that no trial and error iterations are necessary for changing system dimensions. The method of the present invention allows various volume and length specifications for chosen system components to be evaluated early in the design process, and allows under the hood space to be allocated for the best possible noise reduction for space available. The method of the present invention also improves sound quality through reductions in noise levels and introduction of system resonant harmonics.

While the above detailed description describes the preferred embodiment of the present invention, the invention is susceptible to modification, variation and alteration without deviating from the scope and fair meaning of the subjoined claims.

What is claimed is:

1. A method of minimizing engine noise emitted from a motor vehicle air intake system, comprising the steps of:

selecting an objective function to be minimized using a Genetic Algorithm;

generating an acoustic source model of a motor vehicle engine from measured engine parameters;

generating a model of required air induction system components from measured component parameters;

selecting a set of air induction system components and system dimensional constraints; and generating a model of the air induction system given the generated models of the acoustic source and the required induction system components, the selected air induction system components and the system dimensional constraints to thereby minimize the objective function.

2. The method of claim 1, wherein the step of generating an acoustic source model of the motor vehicle engine and intake manifold comprises:

attaching a straight pipe to the intake manifold;

measuring engine sound pressure level and inducted air velocity at the straight pipe attachment location; and storing the measured engine sound pressure level and inducted air velocity for system modeling purposes.

3. The method of claim 2, further comprising the steps of:

measuring engine sound pressure level and inducted air velocity individually for a plurality of straight pipes, each having a different associated length; and storing sound pressure level and inducted air velocity data for each different pipe length for system modeling purposes.

4. The method of claim 3, further comprising the step of converting measured engine sound pressure level and inducted air velocity to a frequency domain via a Fast Fourier Transform method.

5. The method of claim 1, wherein the step of generating an acoustic source model of a motor vehicle engine comprises:

simulating motor vehicle engine thermodynamic processes; and calculating theoretical engine sound pressure level and inducted air velocity from the modeled thermodynamic processes.

6. The method of claim 1, wherein the step of selecting an objective function comprises selecting an objective function as one of the following: unweighted sound pressure level (SPL) inside the motor vehicle, unweighted SPL outside the motor vehicle, weighted SPL inside the motor vehicle, weighted SPL outside the motor vehicle, overall air induction system dimensions, individual air induction system component volume requirements, and individual air induction system component length requirements.

7. The method of claim 1, wherein the step of modeling an air induction system comprises the step of modeling an air induction system utilizing a resonator(s) air induction system tubing and air induction system filters.

8. The method of claim 1, wherein the step of modeling an air induction system comprises the step of selecting air induction system component dimensional requirements and system locations.

9. The method of claim 1, further comprising the step of post-processing the optimized modeled air induction system for noise characteristic evaluation purposes.

10. The method of claim 9, wherein the step of post-processing the model of the air induction system comprises evaluating total engine generated sound pressure level versus crankshaft angular velocity (RPM) for a plurality of generated model induction systems.

11. The method of claim 9, wherein the step of post-processing the generated optimized air induction system comprises creating a plurality of digital sound files in response to a plurality of generated model intake systems.

12. The method of claim 1, further comprising the step of creating a transmission matrix of chosen air induction functions to correlate engine sound pressure level and inducted air velocity at the manifold to engine sound pressure and inducted air velocity at an air induction system output.

13. A method of minimizing emitted engine noise, comprising the steps of:

selecting an objective function to be minimized using a Genetic Algorithm;

generating a model of a motor vehicle engine as an acoustic source from measured engine parameters;

selecting components to comprise an engine noise emission source; and generating a model of a noise emission source by minimizing the objective function and thereby optimizes the design of the noise emission source, given the constraints placed on the source design by the components selected to comprise the source.

14. The method of claim 13, wherein the step of selecting components to be used in the noise emission source comprises selecting components to design an engine air induction system.

15. The method of claim 13, wherein the step of selecting components to comprise the noise emission source comprises selected components to design an engine exhaust system.

16. The method of claim 13, further comprising the step of inputting implementation volume dimensional constraints, the step of generating a model of a noise emission source being limited by the input dimensional constraints.

17. A method of minimizing engine noise emitted from a motor vehicle air induction system, comprising the steps of:

inputting measured motor vehicle engine parameters;

modeling a motor vehicle engine as an acoustic source from said input motor vehicle engine parameters;

inputting sound pressure level and velocity data associated with the acoustic source;

selecting induction system components from a predetermined group of components;

entering dimensional requirements of the selected induction system components; and using a Genetic Algorithm to optimize an induction system design by evaluating data from the above steps of modeling a motor vehicle engine as an acoustic source, inputting sound pressure level and velocity data associated with the acoustic source, selecting induction system components from a predetermined group of components, and entering dimensional requirements of the selected induction system components to thereby minimize sound pressure level and velocity of the acoustic source at an air induction system output.

18. A motor vehicle air intake design system, comprising:

a controller;

a memory operatively associated with the controller that stores an objective function to be minimized by using a Genetic Algorithm and that is programmed with system optimization logic;

a first acoustic source submodel of a motor vehicle engine system generated from measured engine parameters;

a second submodel of air intake system components operatively coupled to the acoustic source that is generated from measured intake system component parameters;

a third submodel of an air intake system environment generated from intake environment dimensional constraints;

the controller operative to generate an optimized model of an air intake system through the optimization logic given the objective function, and the first, second and third submodels as inputs to the logic.

* * * * *